US006932673B2

(12) United States Patent
Morita et al.

(10) Patent No.: US 6,932,673 B2
(45) Date of Patent: Aug. 23, 2005

(54) GRINDING METHOD AND DEVICE FOR THE SAME

(75) Inventors: Hiroshi Morita, Aichi-ken (JP); Takayuki Yoshimi, Toyohashi (JP); Ryohei Mukai, Nagoya (JP)

(73) Assignee: Toyoda Koki Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 10/375,948

(22) Filed: Feb. 28, 2003

(65) Prior Publication Data

US 2004/0005844 A1 Jan. 8, 2004

(30) Foreign Application Priority Data

Feb. 28, 2002 (JP) ..... 2002-55046

(51) Int. Cl.[7] ..... B24B 49/00; B24B 51/00; B24B 1/00

(52) U.S. Cl. ..... 451/7; 451/53; 451/449

(58) Field of Search ..... 451/7, 53, 449, 451/450

(56) References Cited

U.S. PATENT DOCUMENTS

| | | | | | |
|---|---|---|---|---|---|
| 2,301,069 | A | | 11/1942 | Mulholland | |
| 2,899,781 | A | * | 8/1959 | Williams | 451/450 |
| 3,325,949 | A | * | 6/1967 | Fisher | 451/450 |
| 3,568,377 | A | * | 3/1971 | Blohm et al. | 451/444 |
| 3,834,088 | A | * | 9/1974 | Matson | 451/450 |
| 4,830,553 | A | | 5/1989 | Abeyta et al. | |

FOREIGN PATENT DOCUMENTS

| | | | | |
|---|---|---|---|---|
| JP | 51-146490 | | 11/1976 | |
| JP | 51-146490 S | | 11/1976 | |
| JP | 361241065 A | * | 11/1986 | B24B/55/02 |
| JP | 02-100770 | | 8/1990 | |
| JP | 06-008143 | | 1/1994 | |
| JP | 06-155300 | | 3/1994 | |
| JP | 10296633 A | * | 11/1998 | B24B/55/02 |
| JP | 02003275958 A | * | 9/2003 | B24B/55/02 |

OTHER PUBLICATIONS

Patent Abstract of Japan for JP06–008143 published on Jan. 1, 1994.

Patent Abstract of Japan for JP06–155300 published on Mar. 6,–1994.

Concise explanation of Japanese Laid–Open Utility Model Publication No. Sho 51–146490.

Concise explanation of Japanese Laid–Open Utility Model Publication No. Hei 2–100770.

* cited by examiner

*Primary Examiner*—M. Rachuba
(74) *Attorney, Agent, or Firm*—Darby & Darby

(57) ABSTRACT

The present invention supplies coolant to a grinding wheel surface and reliably guides the coolant to a grinding point on the grinding wheel surface, thereby significantly reducing the amount of coolant to be used.

In a grinding method and device for supplying coolant while grinding a workpiece W with a rotating grinding wheel 1, a fluid nozzle 2 is disposed upstream from a grinding point 11 on the circumferential surface 10 of the grinding wheel 1. The fluid nozzle 2 blows a jet of fluid across an air layer 12, which is a layer of flowing air dragged along the circumferential surface 10 of the grinding wheel 1, from one lateral side of the air layer 12 to the other lateral side thereof. A grinding fluid nozzle 3 supplies coolant to a region between the grinding point 11 and a cutoff position 13 at which the fluid jet from the fluid nozzle 2 has deflected the air flow from the air layer 12. The coolant supplied from the grinding fluid nozzle 3 contacts the grinding point 11 on the grinding surface 10.

8 Claims, 22 Drawing Sheets

Fig. 15
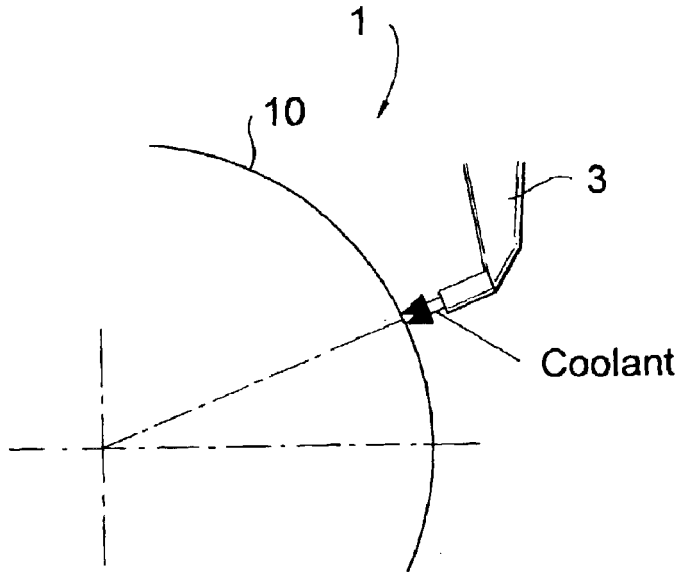
Peripheral Grindstone Speed 120 m/sec
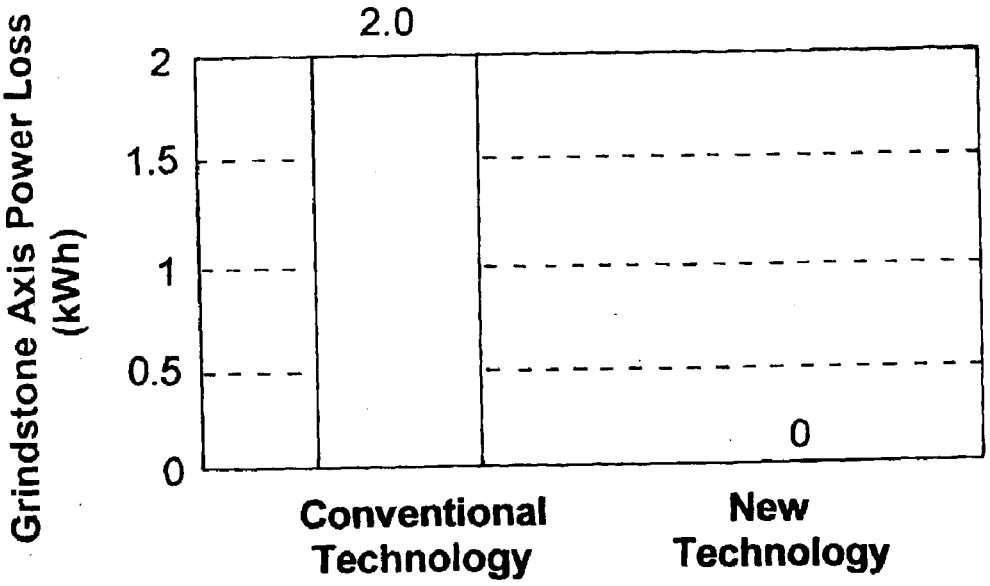
Fig. 16

Coolant Flow when Stopping Air is Used
(Coolant Volume 2～3L/min)

*Reaches grindstone surface and is guided to grinding point

Coolant Flow with No Air
(Coolant Flow 2~3 L/min)

*Does not reach grindstone surface due to air layer

GRINDING METHOD AND DEVICE FOR THE SAME

INCORPORATION BY REFERENCE

The present application claims priority under 35 U.S.C. Section 119 to Japanese Patent Application No. 2002-55046 filed on Feb. 28, 2002. The contents of this application are incorporated herein by reference in its entirety.

FIELD OF THE INVENTION

The present invention relates to a grinding method and device for the same wherein a workpiece is ground with a rotating grinding wheel while a coolant is supplied to a grinding point between the workpiece and the surface of the grinding wheel.

BACKGROUND OF THE INVENTION

Japanese Utility Model Publication Number Sho 51-146490 (Japanese Utility Model Application Number Sho 50-66966) discloses a conventional coolant-supplying device as shown in FIG. 19. The conventional coolant-supplying device includes an air nozzle E which blows air A to a position that is upstream (relative to the rotation of the grinding wheel) from a position where a coolant C sprayed from a coolant nozzle CN contacts a grinding wheel G. As a result, the rotation of an air layer following the circumferential surface of the grinding wheel is obstructed, and the air flow does not reach the grinding point. Thus, the coolant C can be effectively supplied to the grinding point.

However, in this conventional coolant-supplying device, air A is blown against the circumferential surface of the grinding wheel G in a direction that is opposite to the direction of rotation of the grinding wheel G. Thus, air flow dragged by the circumference of the grinding wheel opposes the flow from the air nozzle E, which results in turbulence. The turbulence impedes the supply of coolant to the grinding point.

Japanese Utility Model Number Hei 2-100770 (Japanese Utility Model Application Number Hei 1-7603) discloses a grinding wheel cleaning device for a conventional grinder as shown in FIG. 20. This grinding wheel cleaning device includes a grinding wheel washing device GC disposed inward from a coolant nozzle CN of a coolant spraying device so that the grinding wheel washing device GC is positioned close to the grinding wheel G. The cleaning nozzle GCN is a pipe with an opening at the end formed from applying pressure to compress it into the shape of a tongue. The cleaning nozzle GCN applies a uniform spray horizontally across the entire width of the grinding surface of the grinding wheel G to remove grinding chips that adhere to and clog the pores of the grinding surface. Thus, the grinding surface is maintained in a proper state.

However, the object of a grinding wheel cleaning device is different from that of the present invention. Moreover, the spray that blows away debris from the grinding surface of the grinding wheel G obstructs the coolant supply to the grinding point.

Japanese Laid-Open Patent Publication Number Hei 6-8143 discloses a conventional coolant fluid supplying device as shown in FIG. 21. The conventional coolant fluid supplying device includes a fairing P with a wing-shaped cross-section positioned close to the grinding point on a circumferential surface GO of the grinding wheel G. The fairing P is supported at an appropriate distance from the grinding wheel G and at an angle that is based on the diameter of the grinding wheel G. The fairing P regulates the flow of the air layer generated near the circumferential surface GO when the grinding wheel G is rotated at high speeds. When supplying coolant fluid between the fairing P and the grinding wheel G, a large amount of the coolant fluid can be guided to the grinding point.

However, in this conventional coolant fluid supplying device, the coolant fluid cannot be reliably guided to the grinding point at the surface of the grinding wheel G since the air flow in the air layer, which is regulated by the fairing P, is present at the grinding point.

A conventional coolant supply device used in ultra high speed machining as shown in FIG. 22 is disclosed in Japanese Laid-Open Patent Publication Number 6-155300. The conventional coolant supply device provides coolant which is sprayed at a high pressure from a first nozzle N to a grinding point K. An air film forms on the circumferential surface of the grinding wheel G. A stopping plate SP disposed above the grinding point K prevents the air film from reaching the grinding point K.

However, in this conventional coolant supply device for ultra high speed machining, a gap is formed between the stopping plate SP and the circumferential surface of the grinding wheel G, and this gap prevents the stopping plate SP from completely preventing the air film from reaching the grinding point K. Therefore, it is necessary to spray coolant at a high spray pressure, which does not allow a low volume of coolant flow to be guided to the grinding point.

SUMMARY OF THE INVENTION

The present invention provides a grinding method in which a workpiece is ground with a grinding wheel while a coolant is supplied to the surface of the grinding wheel. An air layer of flowing air is dragged along the circumference of the rotating grinding wheel. The air layer is blown away horizontally, thereby redirecting the air flow of the dragged air layer. As a result, the air layer on the circumferential surface of the grinding wheel and the air flow from the air layer is eliminated below the cutoff position at which the air flow is redirected. Coolant is supplied to the grinding wheel surface at a position above the grinding point and from which this air layer has been eliminated. The coolant is guided along the surface of the grinding wheel to the grinding point. The present invention supplies coolant to the grinding wheel surface and reliably guides the coolant to the grinding point on the grinding wheel surface. The present invention also significantly reduces coolant usage.

The grinding method includes removing an air layer, i.e., a layer of flowing air dragged along a circumference of the rotating grinding wheel, by blowing the air layer horizontally in a direction different than the direction of rotation of the grinding wheel, such as a lateral direction. The grinding method also includes supplying the coolant to a position above the grinding point and from which the air layer has been removed and guiding the coolant along the grinding wheel surface to a grinding point. As a result, the coolant can be supplied to the grinding wheel surface and reliably guided to the grinding point, thus significantly reducing the amount of used coolant.

Additionally, the grinding method includes providing a fluid jet which can be blown across the air layer, i.e., a layer of flowing air dragged along a circumference of the rotating grinding wheel, at a position above the grinding point on the grinding wheel surface. The fluid jet is blown from one lateral side of the air layer to the other lateral side, and this fluid jet redirects the dragged air layer. The coolant can be supplied between the cutoff position and the grinding point, and the coolant is able to reach the grinding point on the grinding surface. As a result, the coolant supplied to the grinding wheel surface can be reliably guided to the grinding point on the grinding wheel surface.

Additionally, the present invention provides a grinding device for grinding a workpiece with a rotating grinding wheel while supplying a coolant. The grinding device has a fluid nozzle disposed above a grinding point on a grinding surface to blow a fluid jet across an air layer, i.e., a layer of flowing air dragged along a circumference of the rotating grinding wheel, from one lateral side of the air layer to another lateral side. The grinding device also has a grinding fluid nozzle for supplying a coolant between the grinding point and a cutoff position at which the dragged air layer is redirected and ends as the air flow from the air layer is redirected by being blown away by the fluid jet from the fluid nozzle. Furthermore, the coolant supplied from the grinding fluid nozzle reaches the grinding point on the grinding wheel surface. As a result, the coolant can be supplied to the grinding wheel surface and can be reliably guided to the grinding point on the grinding wheel surface.

Additionally, the fluid nozzle of the grinding device can be disposed at a fixed angle range relative to the circumferential surface of the grinding wheel on a horizontal plane. As a result, the air layer, i.e., the layer of flowing air dragged along a circumference of the rotating grinding wheel, can be blown away horizontally with a fluid jet. This redirects the air flow of the air layer while preventing the volume of the fluid jet from obstructing the supply of coolant to the grinding point.

Additionally, the fluid nozzle of the grinding device can be disposed at a fixed angle range relative to the axis of the grinding wheel on a vertical plane. As a result, the air layer, i.e., the layer of flowing air dragged along a circumference of the rotating grinding wheel, can be reliably blown away in the horizontal or lateral direction with a fluid jet, thus removing the air layer.

Additionally, the fluid nozzle of the grinding device can be disposed at a fixed distance range above a contact point where the coolant supplied from the grinding fluid nozzle reaches the surface of the grinding wheel. As a result, the air layer, i.e., the layer of flowing air dragged along a circumference of the rotating grinding wheel, can be reliably blown away in the horizontal or lateral direction with a fluid jet, thus removing the air layer. Coolant can be supplied to the grinding wheel surface from which the air layer has been reliably removed, and the coolant can be reliably guided to the grinding point on the grinding surface.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 15 is a partial side-view drawing of a comparative example for comparison with a grinding method and device according to Example VI;

FIG. 16 is a graph comparing grinding wheel axis power loss between the comparative example of FIG. 15 and a grinding method and device according to Example VI;

LIST OF DESIGNATORS

Figure 1:
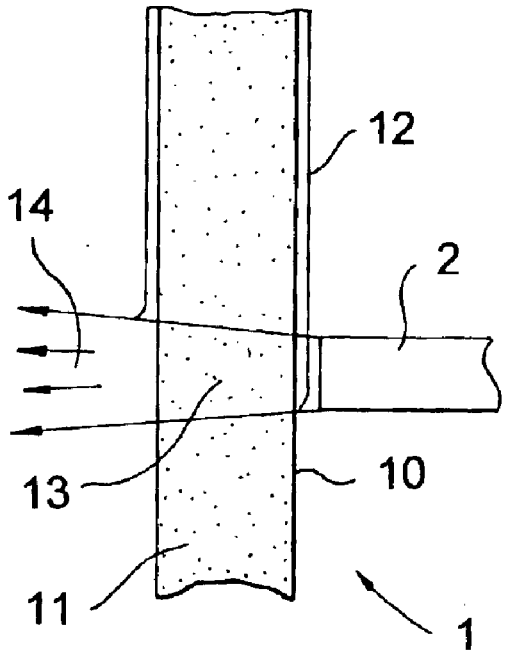
FIG. 1 is a partial front-view drawing of the flow of an air layer along the circumferential surface of a grinding wheel and an air jet redirecting the flow in a grinding method and device according to an embodiment of the present invention.

1: grinding wheel
2: fluid nozzle
3: grinding fluid nozzle
W: workpiece
10: circumferential surface
11: grinding point
12: air layer
13: cutoff position

DETAILED DESCRIPTION OF THE PREFERRED EMBODIMENTS

Figure 2:
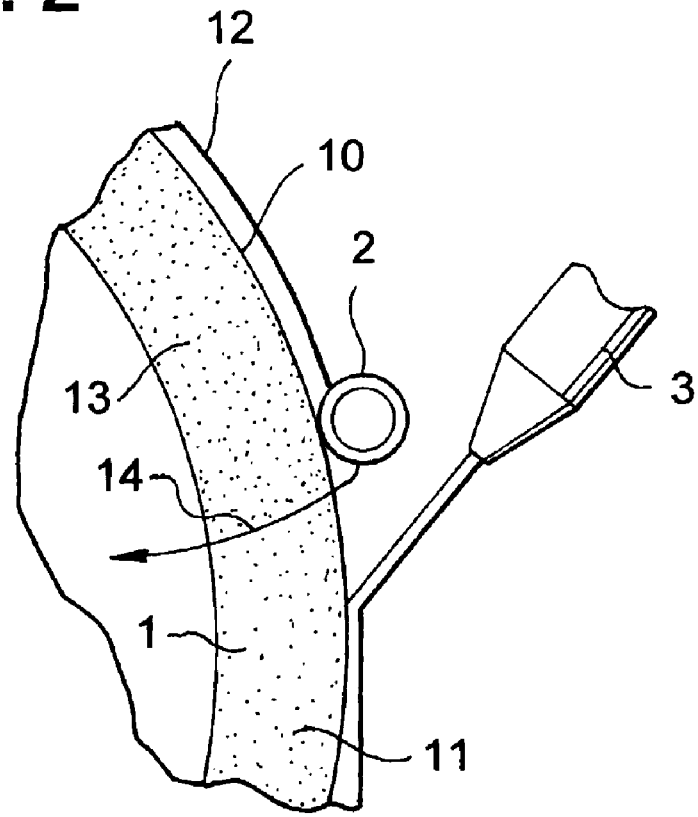
FIG. 2 is a partial side-view drawing of the flow of an air layer along the circumferential surface of a grinding wheel and the flow of a coolant in a grinding method and device of FIG. 1.
Figure 3:
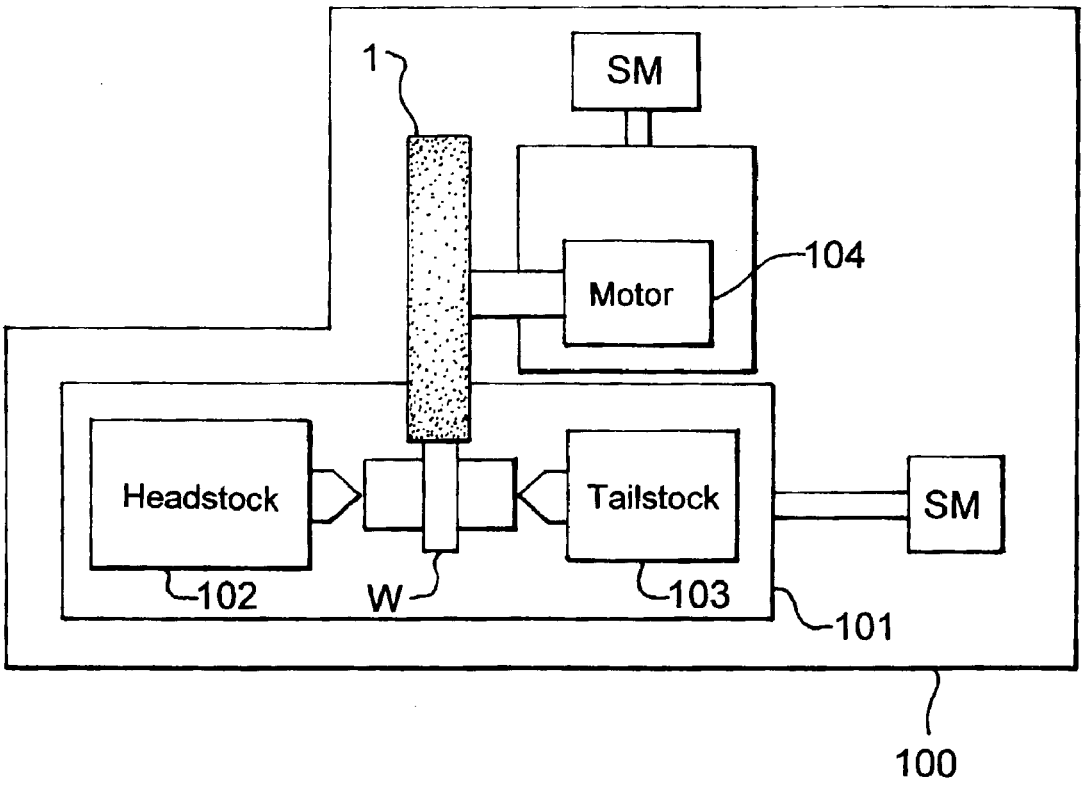
FIG. 3 is a plan drawing of the grinding device of FIG. 1.

A method for grinding and a device for the same according to an embodiment of the present invention is shown in FIGS. 1–3. A workpiece W is ground using a grinding wheel 1 that is rotated while a coolant is supplied to the grinding wheel 1. A fluid nozzle 2 is disposed above a grinding point 11 on the circumferential surface 10 of the grinding wheel 1. The fluid nozzle 2 blows a fluid jet across an air layer 12, from one lateral side of the air layer 12 to the other side. The air layer 12 is a layer of flowing air which is dragged along the circumferential surface 10 of the grinding wheel 1 as the grinding wheel 1 rotates. A grinding fluid nozzle 3 supplies coolant to the circumferential surface 10 of the grinding wheel 1 between the grinding point 11 and a cutoff position 13. The cutoff position 13 is the position where the dragged air layer 12 ends and the air flow from the air layer 12 is redirected by the fluid jet from the fluid nozzle 2. Therefore, the air layer 12 is eliminated in the region between the grinding point 11 and the cutoff position 13 on the circumferential surface 10 of the grinding wheel 1. The coolant supplied from the grinding fluid nozzle 3 contacts the grinding point 11 on the circumferential surface 10 of the grinding wheel 1.

A grinding machine according to an embodiment of the present invention is shown in FIG. 3. A table 101 moves linearly over a bed 100 due to the rotation of a servo motor SM. A headstock 102 and a tailstock 103 are separated by an adjustable distance and support the respective sides of the workpiece W. A motor 104 is disposed facing and parallel to the workpiece W. The motor 104 rotates the grinding wheel 1 which grinds the circumferential surface 10 of the workpiece W.

The fluid nozzle 2 as shown in FIGS. 1–2 is an air jet nozzle positioned horizontally or laterally and parallel to the axis of the grinding wheel 1. The fluid nozzle 2 blows a horizontal jet of fluid, such as an air jet, that crosses the air layer 1 from one lateral side to the other lateral side of the air layer 12. The fluid jet is blown from the fluid nozzle 2 along the circumferential surface 10 of the grinding wheel 1 from a fixed distance above the grinding point 11.

An example of the fluid nozzle 2 can be an air jet nozzle that is adjusted to blow 200 normal liters of air per minute (NL/min). A normal liter is a volume of flow at a predetermined temperature and pressure.

The fluid jet from the fluid nozzle 2 bends the flow of air from the air layer 12 in a right angle. The flow from the air layer 12 is blown in a horizontal or lateral direction and the air flow from the air layer 12 is redirected to form a transverse flow 14. Thus, the air layer 12 ends at the cutoff position 13. Between the cutoff position 13 and the grinding point 11, there is a region characterized by low pressure and low air flow where the air layer 12 has been eliminated.

The grinding fluid nozzle 3 is disposed near the circumferential surface 10 of the grinding wheel 1 and points at a fixed angle from above the circumferential surface 10 of the grinding wheel 1. The grinding fluid nozzle 3 can supply coolant between the grinding point 11 and the cutoff position 13 where the air layer 12 ends. The air flow from the air layer 12 is redirected to form a region of low pressure and low air flow between the cutoff position 13 and the grinding point 11. The coolant supplied from the grinding fluid nozzle 3 reaches the surface of the grinding wheel 1 at the grinding point 11 from which the air layer 12 has been removed.

An example of the grinding fluid nozzle 3 is a nozzle that blows 2 liters of coolant per minute (L/min).

In a grinding method and device according to the embodiment of the present invention shown in FIGS. 1–3, a fluid jet, i.e., an air jet is blown from a fixed distance above the grinding point 11 and along the circumferential surface 10 of the grinding wheel 1. The fluid jet is blown horizontally from one lateral side to the other lateral side of the air layer 12 to form a transverse flow 14. As a result, the air layer 12 is prevented from reaching the grinding point 11 by the air jet which acts as a barrier.

The air jet bends the air layer 12 in a right angle, thereby blowing away the dragged air layer 12 from the circumferential surface 10 of the grinding wheel 1 and forming the transverse flow 14. As a result, the dragged air layer 12 ends and the air flow from the air layer 12 is redirected at the cutoff position 13, thereby forming a region of low pressure and low air flow between the cutoff position 13 and the grinding point 11.

The grinding fluid nozzle 3, disposed near the circumferential surface 10 of the grinding wheel 1, is positioned diagonally and upward from the grinding wheel 1. The grinding fluid nozzle 3 supplies coolant between the grinding point 11 and the cutoff position 13, where the air layer 12 ends and the air flow from the air layer 12 is redirected. The coolant supplied by the grinding fluid nozzle 3 contacts the grinding point 11 and is reliably adhered to the surface of the grinding wheel 1 from which the air layer 12 has been removed.

In a grinding method and device according the embodiment of the present invention shown in FIGS. 1–3, the fluid nozzle 2, i.e., the air jet nozzle, is disposed above the grinding point 11 and blows an air jet that crosses the air layer 12 from one lateral side of the air layer 12 to the other lateral side of the air layer 12. The air jet from the fluid nozzle redirects the direction of flow of the air layer 12 in a right angle. The grinding fluid nozzle 3 supplies coolant to a suction region formed between the grinding point 11 and the cutoff position 13, where the dragged air layer 12 ends and the air flow from the air layer 12 is redirected. Thus, the supplied coolant is reliably adhered to the circumferential surface 10 of the grinding wheel 1 and is reliably guided to the grinding point 11 on the circumferential surface 10 of the grinding wheel 1.

In a grinding method and device according the embodiment of the present invention shown in FIGS. 1–3, the fluid nozzle 2, i.e., the air jet nozzle blows air from a direction roughly perpendicular to the circumferential direction of the grinding wheel 1 at a position located above the position where coolant supplied from the grinding fluid nozzle 3 contacts the grinding wheel 1. As a result, the air layer 12 ends at a cutoff position 13 on the circumferential surface 10 of the grinding wheel 1. The cutoff position 13 is located above the position where the coolant contacts the grinding wheel 1. A region of low pressure and low air flow is created, and this allows the coolant to be reliably guided to the grinding point 11 on the circumferential surface 10 of the grinding wheel 1. Therefore, the grinding operation can be performed using a small amount of coolant.

Thus, the amount of used coolant can be significantly reduced in the grinding method and device according the embodiment of the present invention shown in FIGS. 1–3. Additionally, since the coolant flow is low, the loss of axial power in the motor 104 of the grinding wheel 1 caused by the coolant is minimized.

Furthermore, the grinding method and device according the embodiment of the present invention shown in FIGS. 1–3 reduces the amount of dispersed coolant mist, thus preventing the degradation of the work environment. Since the air blown from the fluid nozzle 2, i.e., the air jet nozzle removes the air layer 12 above the grinding point 11, there is no need for an adjustment mechanism to adjust for changes in the diameter of the grinding wheel 1 as is necessary for the conventional technology in the presence of an air layer 12.

Furthermore, the grinding method and device according the embodiment of the present invention shown in FIGS. 1–3 significantly reduces the flow of coolant. This significant reduction in coolant flow eliminates the need for large-scale coolant tanks, high-volume pumps, and high-pressure pumps, which are necessary in the conventional technology. Thus, floor space requirements, coolant-related power consumption, coolant maintenance fees, and fluid disposal fees are significantly reduced.

Examples of the present invention will be described with references to the drawings.

EXAMPLE I

Figure 4:
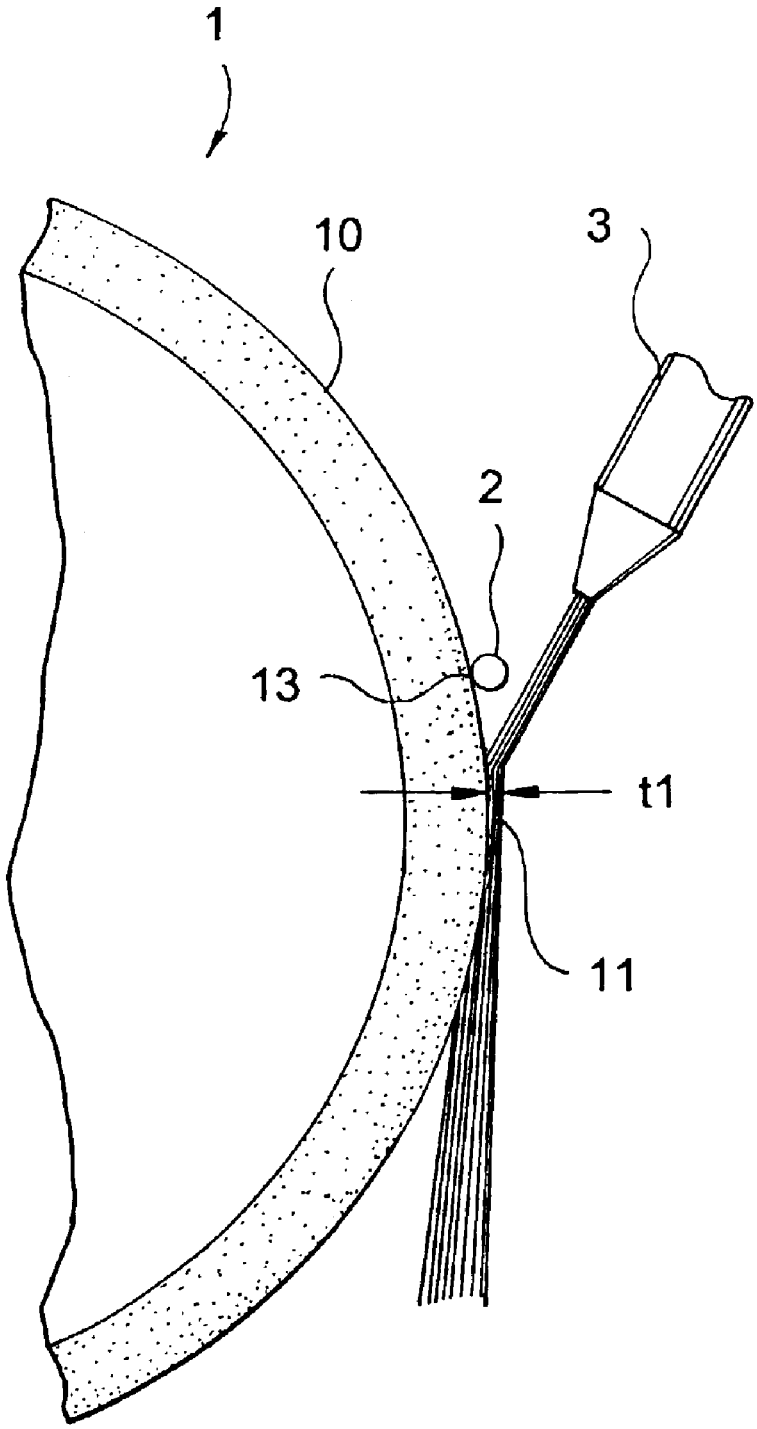
FIG. 4 is a partial side-view drawing of the coolant flow in a grinding method and device according to Example I of the present invention.
Figure 5:
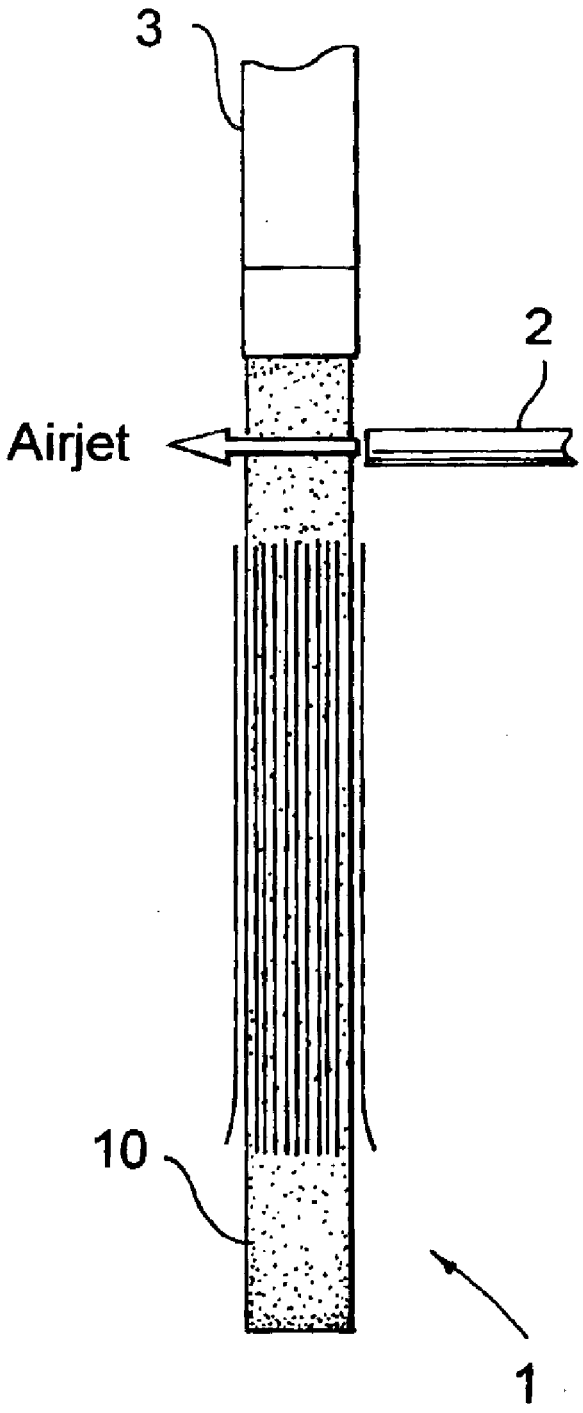
FIG. 5 is a partial front-view drawing of the coolant flow in a grinding method and device according to Example I.

The grinding method and device according to this example having the basic structure and arrangement described above. As shown in FIGS. 4–5, a grinding device supplies a coolant while grinding a workpiece W using a rotating grinding wheel 1.

An air jet nozzle 2 is disposed horizontally or laterally at a position above the grinding point 11 on the circumferential surface 10 of the grinding wheel 1. The air jet nozzle 2 blows an air jet at the air layer 12 (FIGS. 1–2) from one lateral side of the air layer 12 to the other lateral side of the air layer 12. The air layer 12 is a layer of flowing air which is dragged along the circumferential surface 10 of the grinding wheel 1. The air jet deflects the air flow of the dragged air layer 12 at the cutoff position 13. The air flow of the dragged air layer 12 is redirected perpendicularly from the circumferential direction along the circumferential surface 10 of the grinding wheel 1 to a horizontal, lateral direction.

The grinding fluid nozzle 3 that supplies the coolant is disposed between the grinding point 11 and the cutoff position 13 where the air layer 12 flowing along the circumferential surface 10 of the grinding wheel 1 ends and the air flow from the air layer 12 is redirected. Thus, the coolant supplied from the grinding fluid nozzle 3 can reach the grinding point 11 on the circumferential surface 10 of the grinding wheel 1.

The air jet from the air jet nozzle 2 of this example produces a flow volume of 200 normal liters per minute (NL/min). The NL unit refers to normal liters and is the flow volume at a predetermined temperature and pressure.

The peripheral velocity V of the grinding wheel 1 is 80–200 m/s. When the air jet from the air jet nozzle 2 is supplied, the coolant flow volume is 2–3 liters per minute (L/min). The coolant supplied to the grinding point 11 contacts and adheres to the circumferential surface 10 of the grinding wheel 1.

Figure 6:
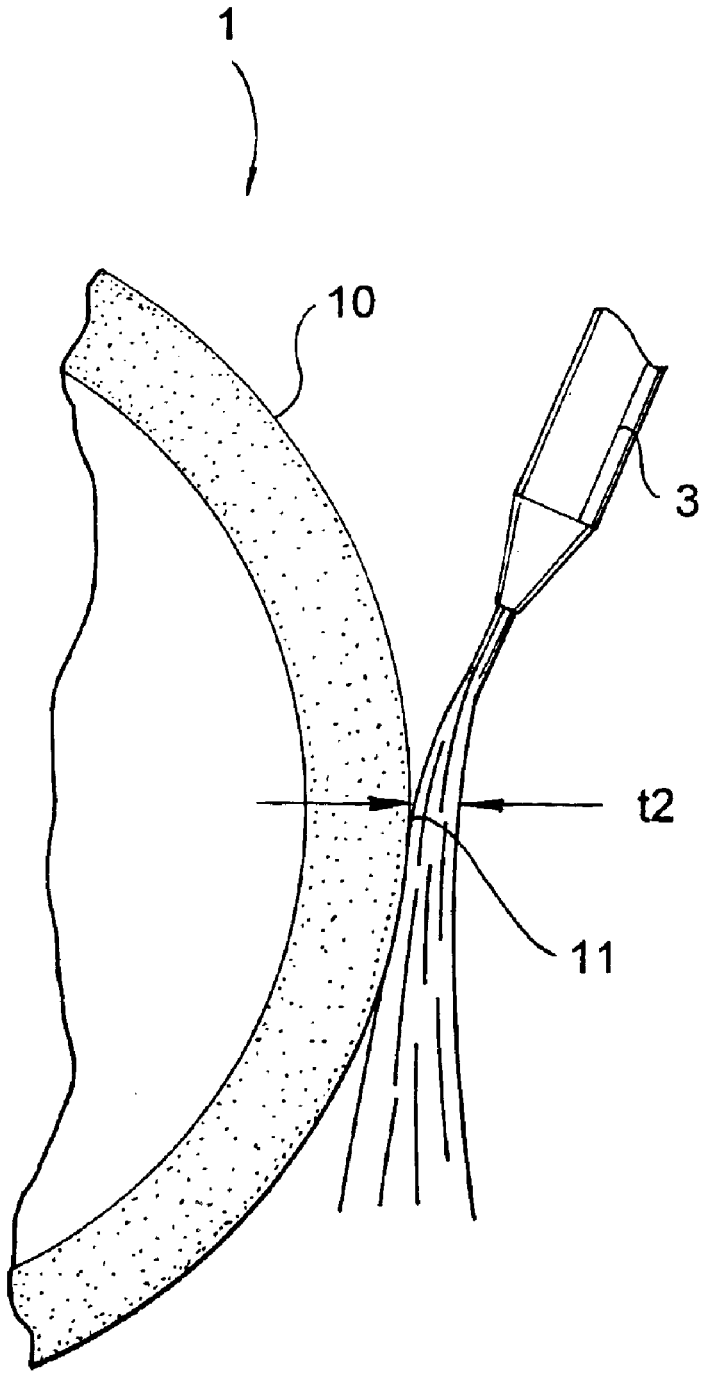
FIG. 6 is a partial side-view drawing of the coolant flow in a grinding method and device according to a comparative example.
Figure 7:
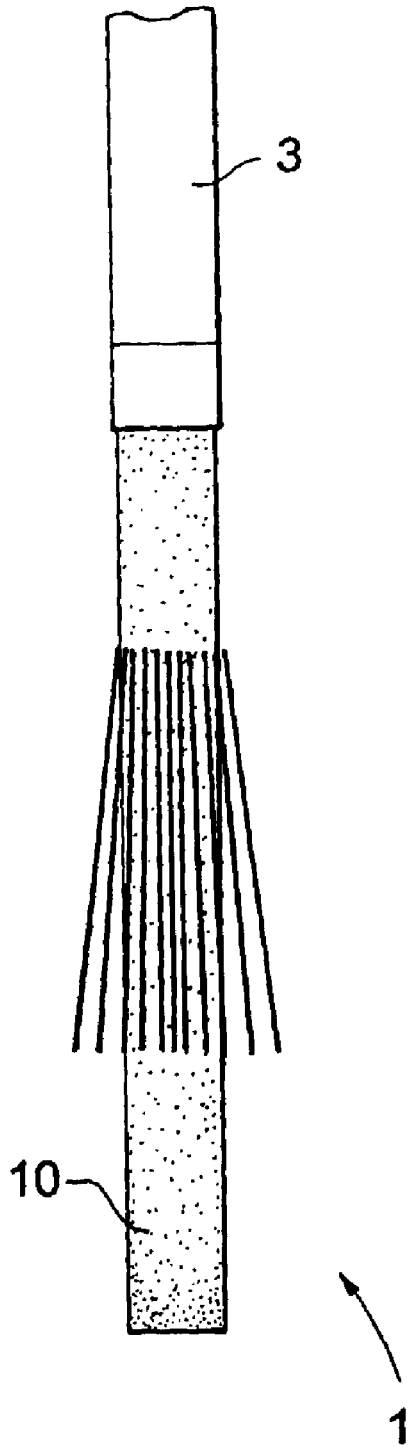
FIG. 7 is a partial front-view drawing of the coolant flow in a grinding method and device according to the comparative example of FIG. 6.

A comparative example is provided to show the advantages of Example I and is shown in FIGS. 6–7. As in Example I, the peripheral velocity V of the grinding wheel 1 in the comparative example is 80–200 m/s and the coolant flow volume is 2–3 L/min. However, in comparison, the air jet from the air jet nozzle 2 is not supplied in the comparative example. Without an air jet from the air jet nozzle 2 for removing the air layer 12, the air layer 12 remains on the circumferential surface 10 as in the conventional technology, and the coolant flow is prevented from reaching the circumferential surface 10 of the grinding wheel 1.

In Example I, an air jet is directed toward the air layer 12, which is positioned along the circumferential surface 10 of the grinding wheel 1, so that the air layer 12 is deflected horizontally or laterally. The dragged air layer 12 changes from moving in the circumferential direction to moving in a horizontal, lateral direction. The coolant from the grinding fluid nozzle 3 is supplied to a region of low pressure and low air flow, which is formed between the grinding point 11 and the cutoff position 13. The air layer 12 is removed from the circumferential surface 10 of the grinding wheel 1 in this region. As a result, the coolant adheres to the region of the circumferential surface 10 of the grinding wheel above the grinding point 11 located on the circumferential surface 10 of the grinding wheel 1.

The coolant from the grinding fluid nozzle 3 contacts the grinding point 11 and adheres to the circumferential surface 10 of the grinding wheel 1. Thus, as shown in FIG. 4, the thickness t1 of the coolant layer is thin. As a result, the density of the coolant in the coolant layer is high. Furthermore, since the air layer 12 is not present, it is possible to provide a coolant layer that does not include an air layer. A coolant layer without an air layer provides significant cooling.

The comparative example described above does not use an air jet from the air jet nozzle 2 to remove the air layer 12 from the circumferential surface 10 of the grinding wheel 1 in the region above the grinding point 13. Since the air layer 12 is present on the circumferential surface 10 of the grinding wheel 1 in the region above the grinding point 13, the coolant flow does not reach the surface of the grinding wheel 1.

More specifically, without an air jet, the coolant from the grinding fluid nozzle 3 gradually disperses while dropping downward due to the presence of the air layer as shown in FIGS. 6–7 in comparison to Example I shown in FIGS. 4–5. The thickness t2 of the coolant layer of the comparative example at the grinding point is at least three times the thickness t1 of the coolant layer of Example I having the air jet. The density of the coolant layer of the comparative example is low, and additionally, there is a layer of air present in the coolant layer of the comparative example. As a result, little cooling is provided for the grinding point 11 in the comparative example.

EXAMPLE II

In a grinding method and device of Example II, the air jet nozzle 2 was positioned at various distances to determine a range of distances for positioning the air jet nozzle 2. The distances are measured upstream from the grinding point 11 relative to the rotation of the grinding wheel. Tests were performed at three grinding wheel speeds to understand how the air jets remove the air layer 12 to allow the coolant from the grinding fluid nozzle 3 to reach the grinding point 11 on the circumferential surface 10 of the grinding wheel 1.

TABLE 1

| Air Nozzle Height | Peripheral Grinding Wheel Speed | | |
|---|---|---|---|
| (From Contact Point) | 80 m/s | 120 m/s | 160 m/s |
| 8 mm | x | | |
| 18 mm | O | O | O |
| 30 mm | O | O | O |
| 50 mm | O | O | O |
| 95 mm | O | O | O |

Figure 8:
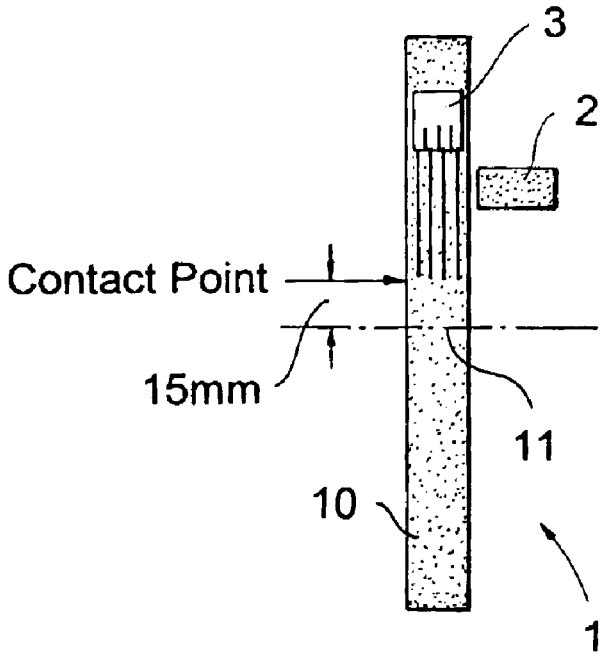
FIG. 8 is a partial front-view drawing showing a different position for an air jet nozzle in a grinding method and device according to Example II of the present invention.
Figure 9:
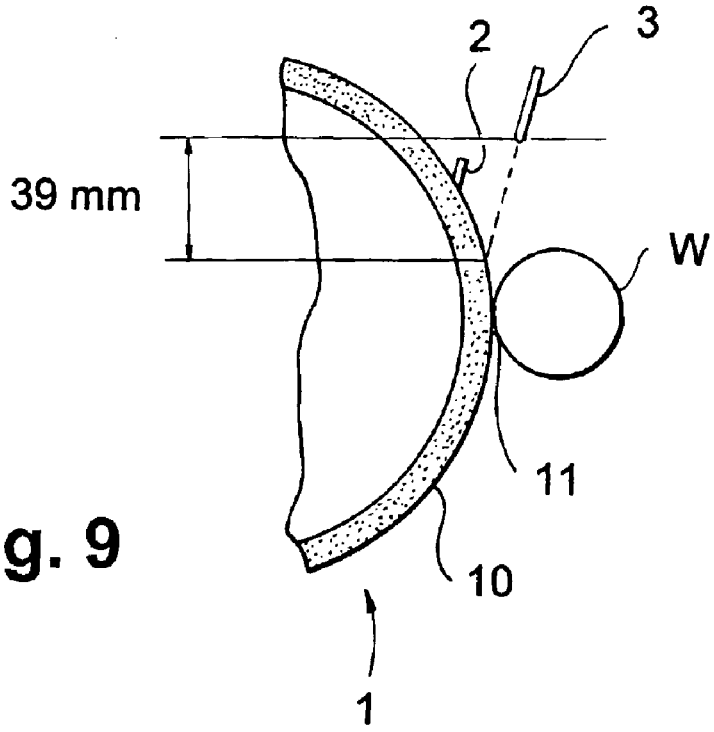
FIG. 9 is a partial side-view drawing showing a different position for an air jet nozzle in a grinding method and device according to Example II.

As shown in FIGS. 8–9 and Table 1, the tests involved four cases where coolant was supplied while the grinding wheel was stationary. For the four cases, the air jet nozzle 2 was positioned at four different vertical distances from the position at which the coolant reaches the circumferential surface 10 of the grinding wheel 1. The four different vertical distances of the air jet nozzle 2 were 18 mm, 30 mm, 50 mm, and 95 mm. As comparative examples, an air jet nozzle 2 was positioned with a vertical distance of 8 mm. The grinding wheel was rotated at peripheral speeds of 80 m/s, 120 m/s, and 160 m/s.

The position of the tip of the grinding fluid nozzle 3 was fixed at 39 mm above the contact point where the coolant contacts the grinding wheel 1, as shown in FIG. 9. The height of the contact point was set to 15 mm above the grinding point 11.

For the 18 mm, 30 mm, and 50 mm tests, the coolant flow volume Q was set to 2 L/min. For the 95 mm test, the coolant flow volume Q was set to 3 L/min.

Table 1 shows the results for Example II at the three peripheral grinding wheel speeds wherein the air jet nozzle 2 was positioned at 18 mm, 30 mm, 50 mm, and 95 mm. For these four cases, Table 1 shows by the indicator "O" that the air jet removed the air layer 12 above the grinding point 11 and allowed the coolant from the grinding fluid nozzle 3 to reach the grinding point 11 on the circumferential surface 10 of the grinding wheel 1.

In the comparative example, the air jet nozzle 2 was positioned at a vertical distance of 8 mm, and as shown by the indicator "x" in Table 1, the coolant was blown away because the opening of the air jet nozzle 2 was too close to the contact position of the coolant.

As the results show, the air jet nozzle 2 can be positioned within a range of positions that are upstream relative to the rotation of the grinding wheel 1. The range of positions has a lower limit and an upper limit. The lower limit is the closest position in which the coolant is not blown away, and the upper limit is the most distant position where the air layer 12 that was removed would not able to form again. Thus, the air jet nozzle 2 can be positioned between the lower limit and the upper limit.

EXAMPLE III

Figure 10A:
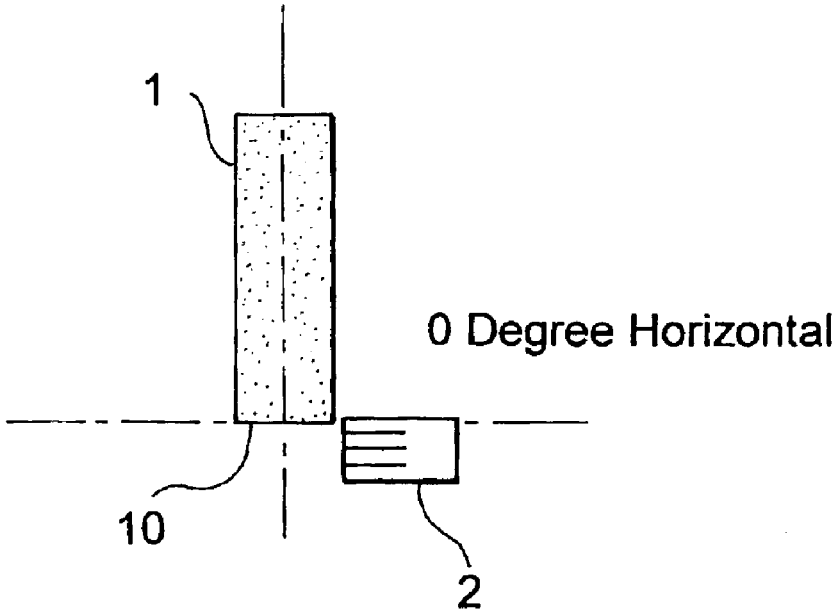
FIG. 10A is a partial plan drawing of an example with an air jet nozzle at a 0° horizontal angle in a grinding method and device according to Example III of the present invention.
Figure 10B:
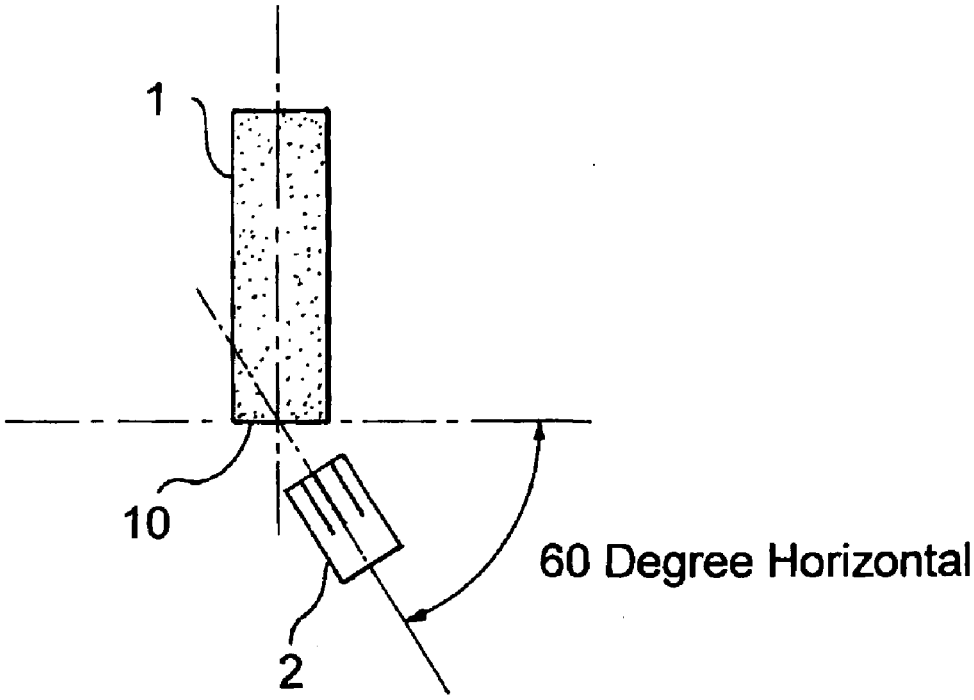
FIG. 10B is a partial plan drawing of an example with an air jet nozzle at a 60° horizontal angle in a grinding method and device according to Example III of the present invention.
Figure 11B:
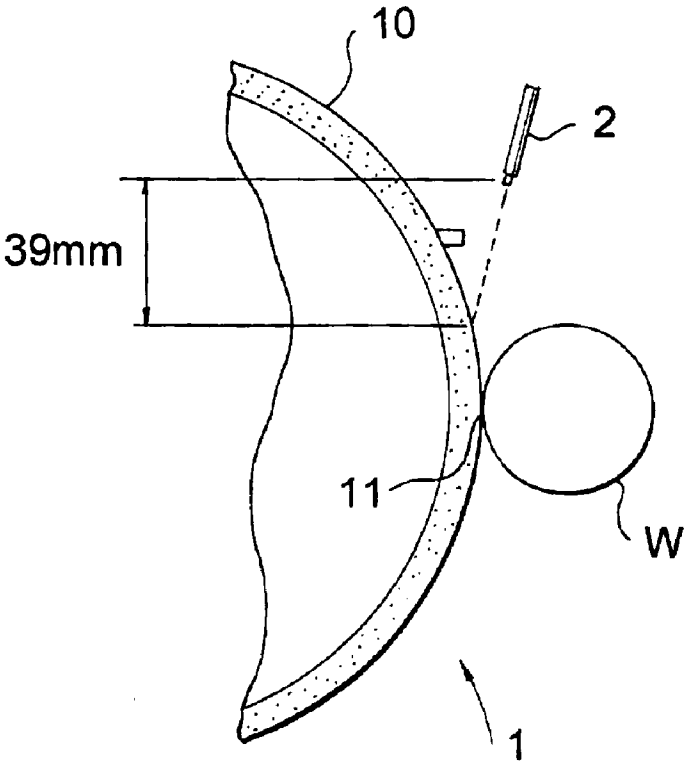
FIG. 11B is a partial side-view drawing showing the positioning of an air jet nozzle and a grinding fluid nozzle in a grinding method and device according to Example III.
Figure 11A:
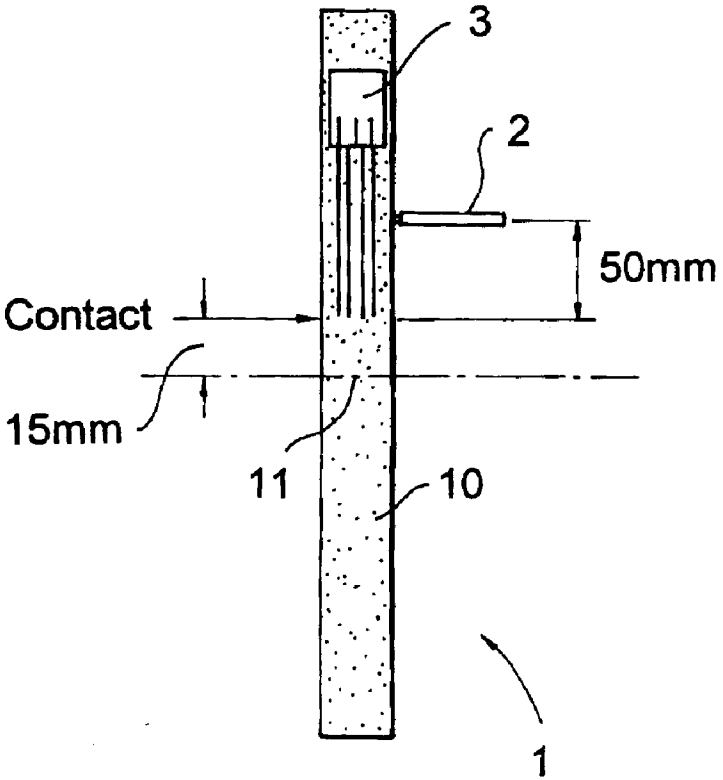
FIG. 11A is a partial front-view drawing showing the positioning of an air jet nozzle and a grinding fluid nozzle in a grinding method and device according to Example III.

In a grinding method and device according to Example III, tests were performed for two examples, as shown in FIGS. 10A–10B, wherein the air jet nozzle 2 is positioned having different nozzle angles relative to a horizontal, lateral reference line tangent to the circumferential surface 10 of the grinding wheel 1. The air jet nozzle 2 is positioned at a horizontal nozzle angle measured relative to a horizontal, lateral line which is parallel to the axis of the grinding wheel 1 and relative to the axial midpoint of the circumferential surface 10 of the grinding wheel 1. The two cases shown in FIGS. 10A–10B were studied to determine if the air jet can remove the air layer 12 to allow the coolant from the grinding fluid nozzle 3 to reach the grinding point on the circumferential surface 10 of the grinding wheel 1.

TABLE 2

| Grinding Fluid Volume | Air Nozzle Height (From Contact Point) | Nozzle Angle | Peripheral Grinding Wheel Speed 160 m/s |
|---|---|---|---|
| 2 L/min | 50 mm | 0° horizontal | O |
| 2 L/min | 50 mm | 60° horizontal | O |
| 2 L/min | 50 mm | 30° vertical | O |
| 2 Llmin | 50 mm | 60° vertical | x |
| 2 L/min | 50 mm | −30° vertical | O |
| 2 L/min | 50 mm | −60° vertical | O |

FIGS. 10A–10B, FIGS. 11A–11B, and Table 2 show the various nozzle angles at which the air jet nozzle 2 was positioned. In the example shown in FIG. 10A, the air jet nozzle 2 was oriented at a nozzle angle of 0° relative to the horizontal, lateral reference line tangent to the circumferential surface 10 of the grinding wheel 1. In addition, the air jet nozzle 2 was positioned 50 mm above the contact point where the coolant contacts the grinding wheel 1 in the example shown in FIG. 10A. In the example shown in FIG. 10B, the air jet nozzle 2 was oriented at a nozzle angle of 60° relative to the same horizontal, lateral reference line. The peripheral grinding wheel speed was 160 m/s and the coolant flow volume Q was 2 L/min.

Table 2 shows by the indicator "O" that the air jet was able to remove the air layer 12 in Example III having either the orientation with a nozzle angle of 0° or a nozzle angle of 60° relative to the horizontal, lateral reference line. Therefore, the coolant from the grinding fluid nozzle 3 can reach the grinding point on the grinding wheel surface in Example III having a nozzle angle of 0° or 60°.

EXAMPLE IV

Figure 12C:
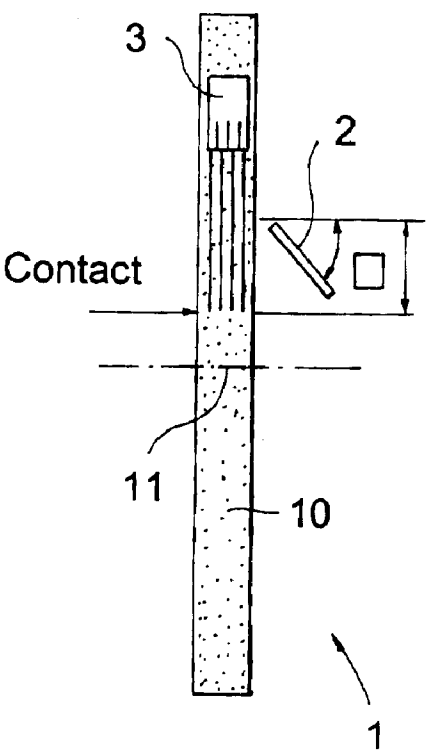
FIG. 12C is a partial front-view drawing of an example of a vertical angle for an air jet nozzle in a grinding method and device according to Example IV of the present invention.
Figure 12B:
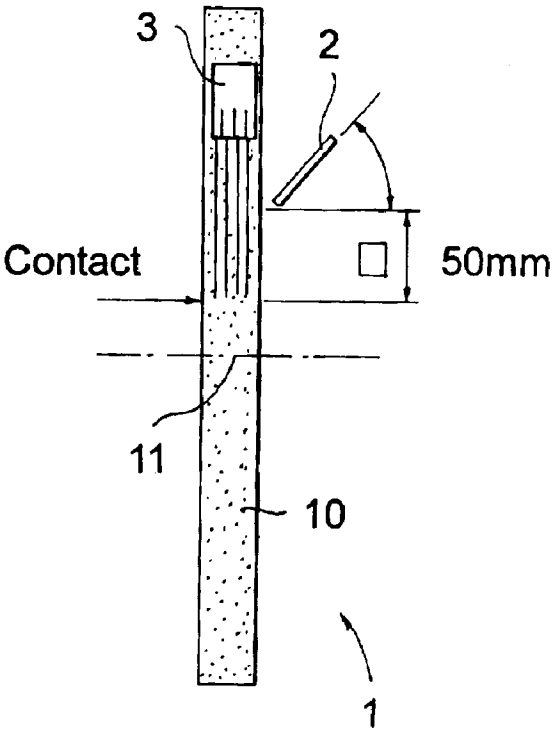
FIG. 12B is a partial front-view drawing of an example of a vertical angle for an air jet nozzle in a grinding method and device according to Example IV of the present invention.
Figure 12A:
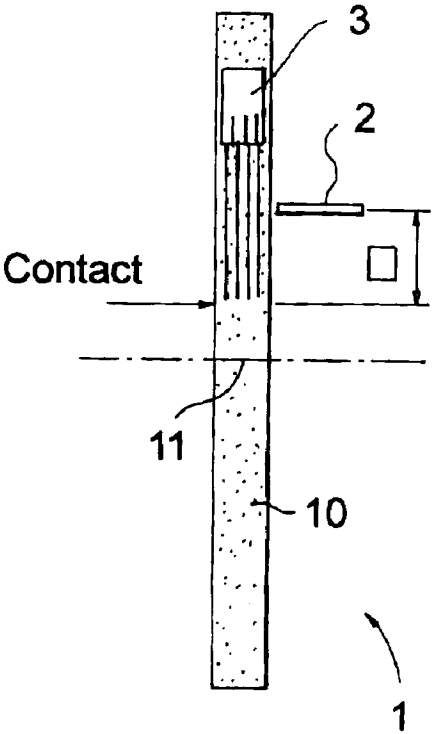
FIG. 12A is a partial front-view drawing of an example of a vertical angle for an air jet nozzle in a grinding method and device according to Example IV of the present invention.
Figure 13A:
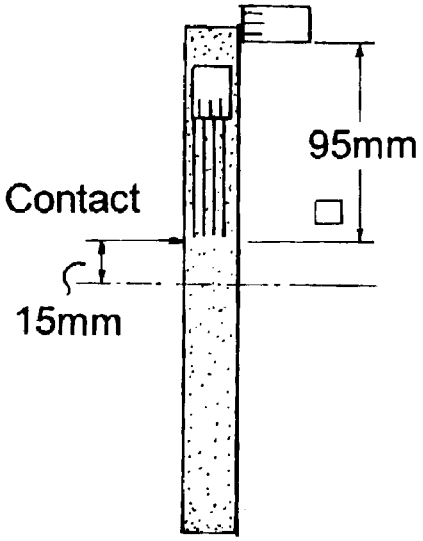
FIG. 13A is a partial front-view drawing showing the positioning of an air jet nozzle and a grinding fluid nozzle in a grinding method and device according to Example V of the present invention.
Figure 13B:
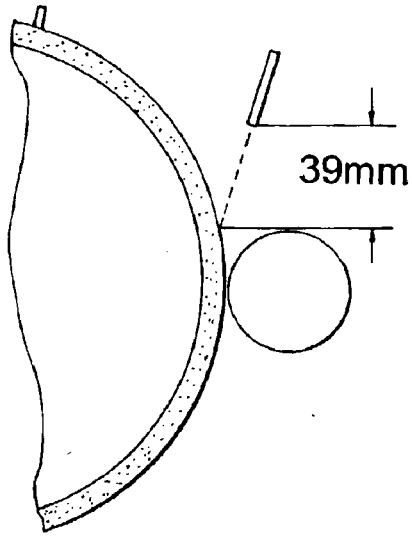
FIG. 13B is a partial side-view drawing showing the positioning of an air jet nozzle and a grinding fluid nozzle in a grinding method and device according to Example V of the present invention.
Figure 14A:
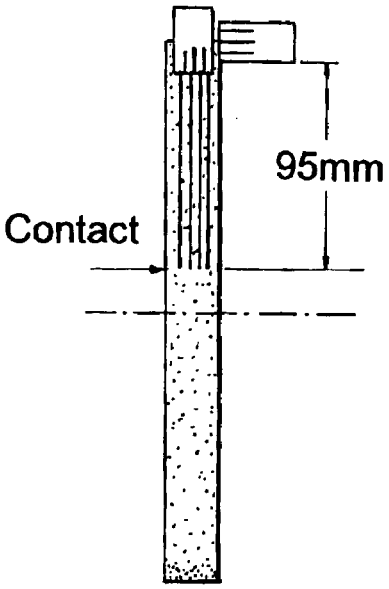
FIG. 14A is a partial front-view drawing showing the positioning of an air jet nozzle and a grinding fluid nozzle in a grinding method and device according to Example V.
Figure 14B:
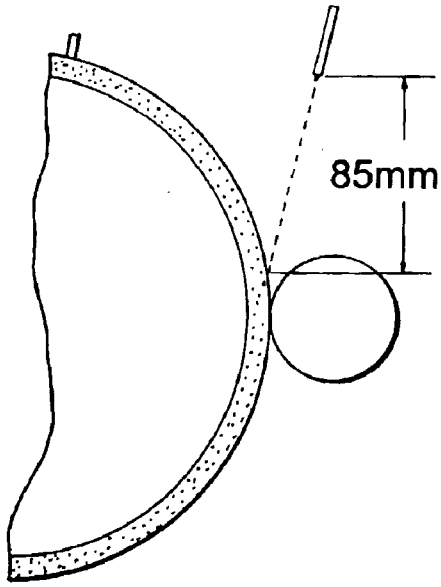
FIG. 14B is a partial side-view drawing showing the positioning of an air jet nozzle and a grinding fluid nozzle in a grinding method and device according to Example V.

In a grinding method and device according to this example, tests were performed on four examples in which the air jet nozzle 2 was oriented at different vertical angles relative to a horizontal plane parallel to the axis of the grinding wheel 1, as shown in FIGS. 12A–12C. The tests determined if the air jet from the air jet nozzle 2 can remove the air layer 12 to allow the coolant from the grinding fluid nozzle 3 to reach the grinding point 11 on the circumferential surface 10 of the grinding wheel 1.

FIGS. 11A–11B, FIGS. 12A–12C, and Table 2 show the various vertical nozzle angles at which the air jet nozzle 2 was positioned. The air jet nozzle 2 was oriented upward at vertical angles of 30° and 60° (shown in FIG. 12B) relative to a horizontal plane positioned 50 mm above the contact point of the coolant on the circumferential surface 10 on the grinding wheel 1. Additionally, the air jet nozzle 2 was oriented parallel to the axis of the grinding wheel 1 at a vertical angle of 0° (shown in FIG. 12A) and oriented downward at vertical angles of −30° and −60° (shown in FIG. 12C) relative to the same horizontal plane. Tests were conducted with a peripheral grinding wheel speed of 160 m/s and a coolant flow volume Q of 2 L/min.

Table 2 shows the results of the tests for air jet nozzles 2 having the upward orientation of 30° and the downward orientations of −30° and −60° relative to the horizontal angle of 0°. Table 2 shows by the indicator "O" that in these cases the air jet can remove the air layer 12 to allow the coolant from the grinding fluid nozzle 3 to reach the grinding point 11 on the circumferential surface 10 of the grinding wheel 1.

However, Table 2 shows by the indicator "x" that when the air jet nozzle 2 was positioned 50 mm above the contact point with an upward orientation of 60° relative to the horizontal angle of 0°, the air jet from the air jet nozzle 2 blew away the coolant at the contact point regardless of the peripheral grinding wheel speed of the grinding wheel 1. Positioning the air jet nozzle 2 higher than 50 mm above the contact point of the coolant on the circumferential surface 10 of the grinding wheel 1 can eliminate this problem.

EXAMPLE V

Figure 22:
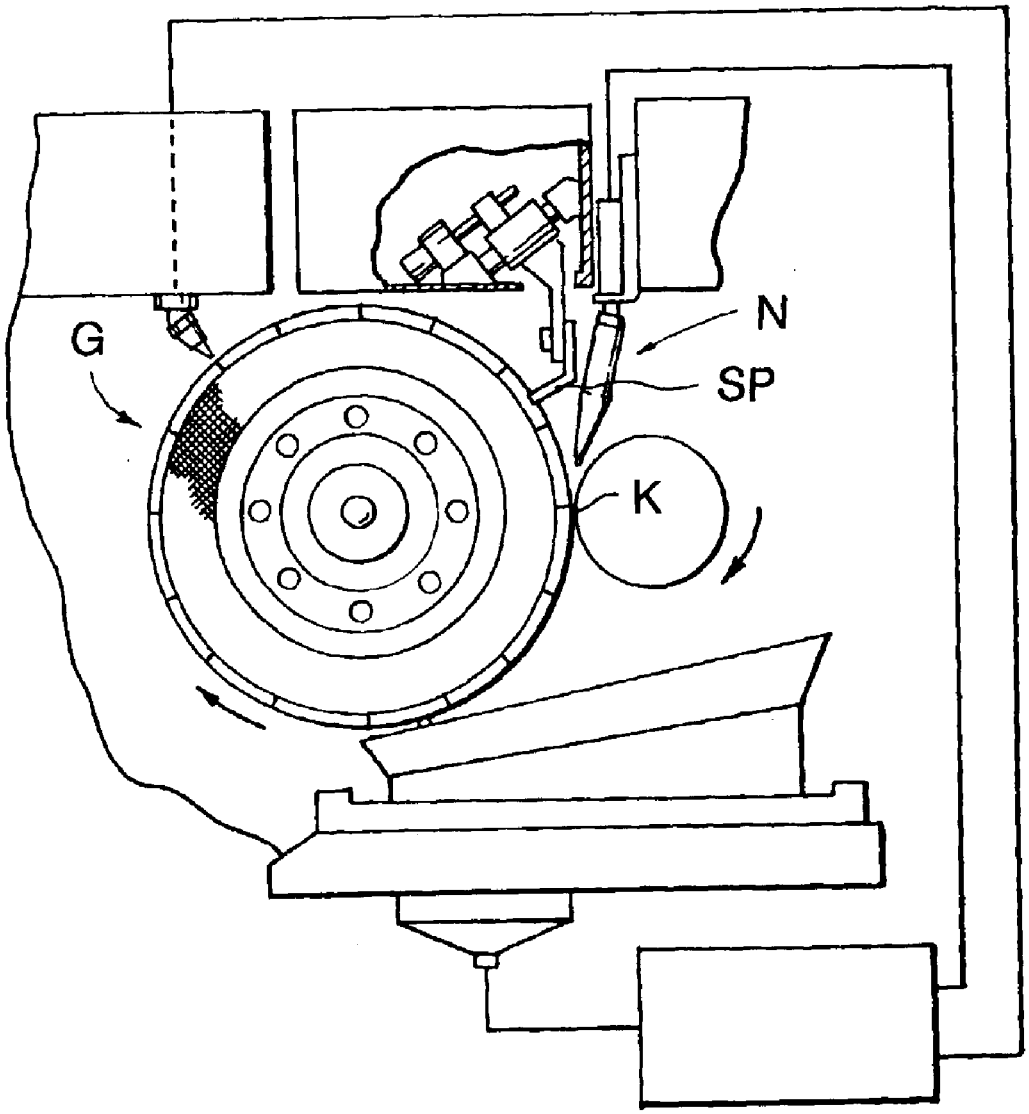
Fig. 22 (Prior Art)
FIG. 22 is a partial side-view drawing of a coolant supply device in a conventional grinding operation.

In a grinding method and device according to this example, the position of the air jet nozzle 2 was fixed while the grinding fluid nozzle 3 was positioned at different heights, as shown in FIGS. 13A–13B and FIGS. 14A–14B. The tests were performed to determine if, in comparison to the conventional stopping plate shown in FIG. 22, the air jet according to the present invention can remove the air layer 12 to allow the coolant from the grinding fluid nozzle 3 to reach the grinding point on the grinding wheel surface.

As shown in FIGS. 13A–13B and FIGS. 14A–14B, the air jet nozzle 2 was positioned 95 mm above the contact point of the coolant on the circumferential surface 10 of the grinding wheel 1. The grinding fluid nozzle 3 was positioned 39 mm above the contact point of the coolant in the example shown in FIGS. 13A–13B and 85 mm above the contact point of the coolant in the example shown in FIGS. 14A–14B. The coolant flow volume Q was 3 L/min.

The tests showed that, when the grinding fluid nozzle 3 is positioned at either 39 mm or 85 mm above the contact point of the coolant on the circumferential surface 10 of the grinding wheel 1, the air jet can remove the air layer 12 above the grinding point 11 of the grinding wheel 1 to allow the coolant from the grinding fluid nozzle 3 to reach the grinding point 11 on the circumferential surface 10 of the grinding wheel 1.

EXAMPLE VI

A grinding method and device according to this example is similar to Example I in which the fluid nozzle 2, i.e., the air jet nozzle, blows air from a direction roughly perpendicular to the direction of the perimeter of the grinding wheel 1 at a position above the contact point on the grinding wheel 1 of the coolant, i.e., the grinding fluid supplied from the grinding fluid nozzle 3. Tests were conducted to study power loss and coolant use in comparison with a comparative example where a right-angle grinding fluid nozzle 3 blows coolant to the circumferential surface 10 of the grinding wheel 1, which rotates with a peripheral speed of 120 m/s, as shown in FIG. 15.

The most prominent feature in Example VI is that the coolant use is 1/15 that of the comparative example, thereby indicating a dramatic reduction in coolant maintenance and disposal fees.

As shown in FIG. 16, the power loss in the grinding wheel rotation motor from blowing the coolant from the right-angle nozzle of the comparative example is 2.0 kW/hour, while the power loss from Example VI is 0 kW/hour. Also, at higher peripheral grinding wheel rotation speeds, the use of the right-angle nozzle tends to lead to greater power loss for the grinding wheel rotation motor from blowing the coolant.

The examples described above are provided for the purpose of describing the present invention, but the present invention is not restricted to these examples. Modifications and additions may be effected by one skilled in the art, based on the claims, the detailed description, and the drawings of the invention without departing from the spirit of the invention.

Figure 17:
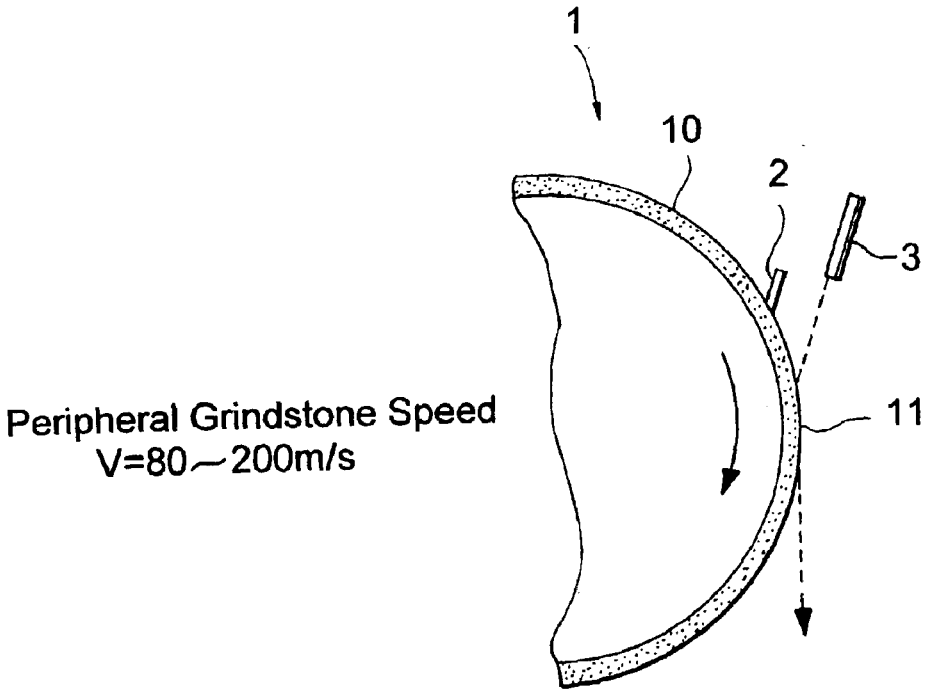
FIG. 17 is a partial side-view drawing providing a simplified illustration of the flow of coolant supplied from a grinding fluid nozzle according to Example I.
Figure 18:
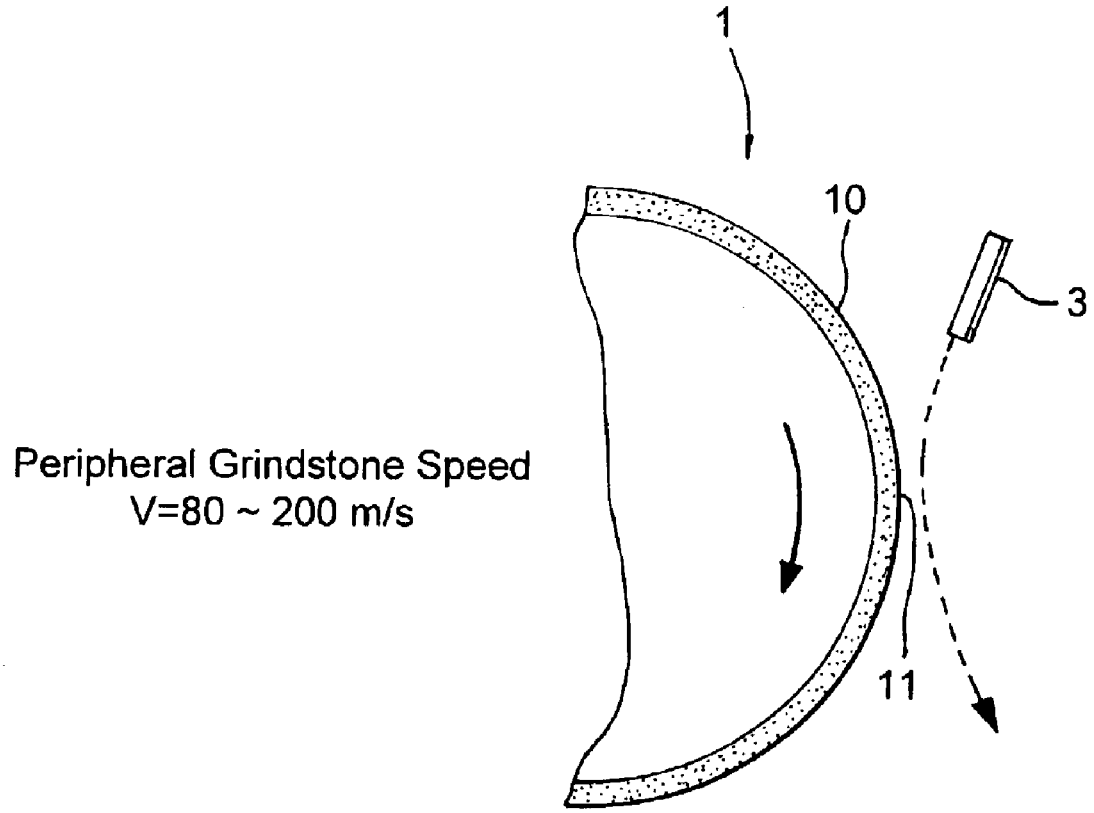
FIG. 18 is a partial side-view drawing providing a simplified illustration of the flow of coolant supplied from a grinding fluid nozzle according to a comparative example.
Figure 19:
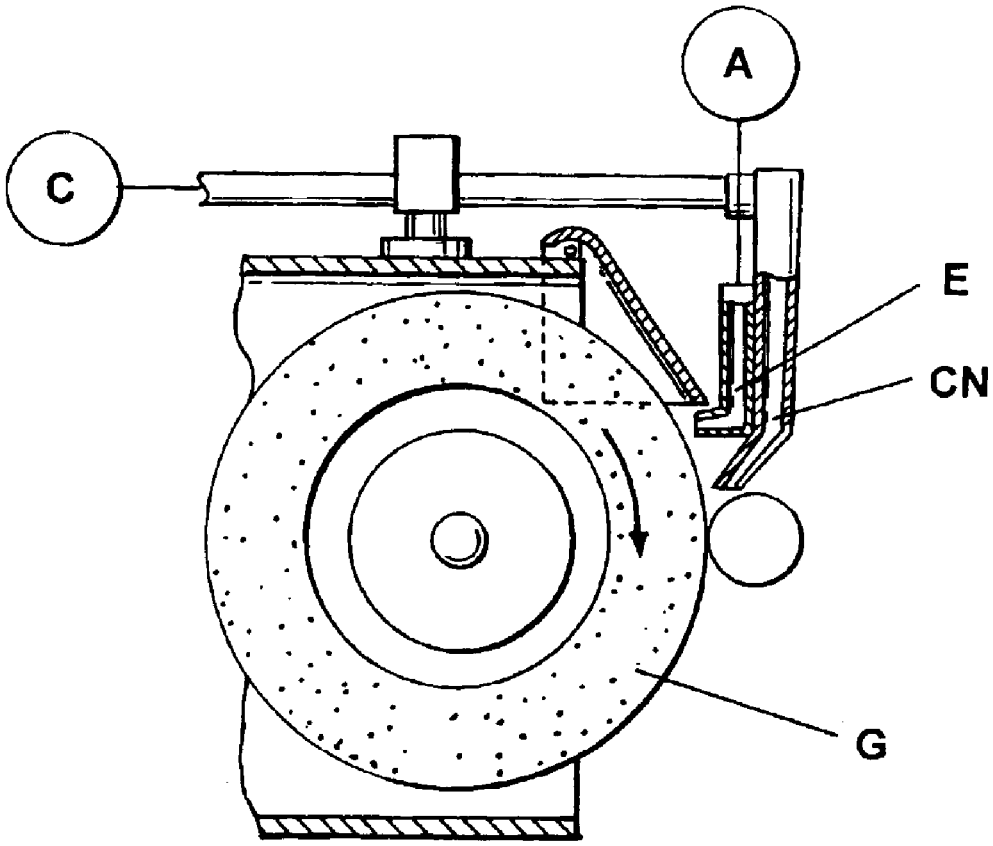
Fig. 19 (Prior Art)
FIG. 19 is a side-view drawing of a conventional coolant supplying device.
Figure 20:
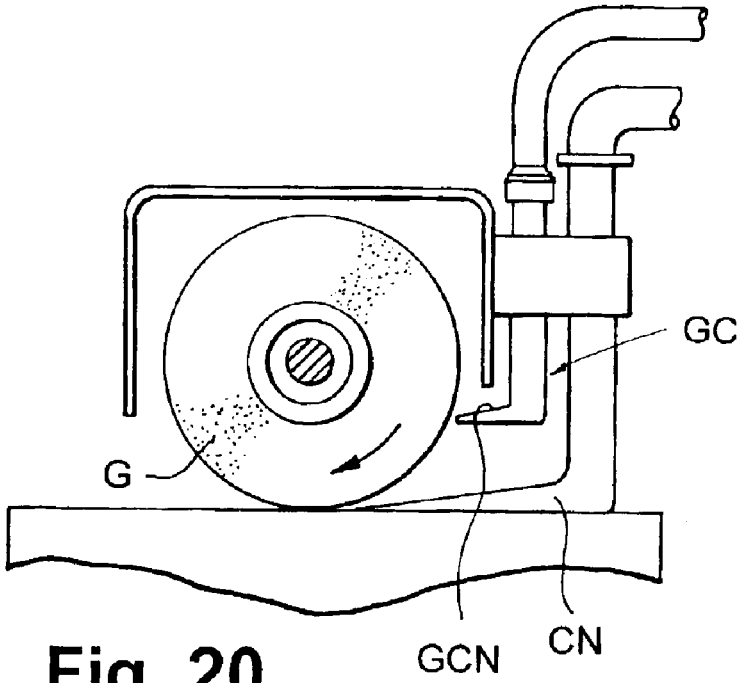
Fig. 20 (Prior Art)
FIG. 20 is a side-view drawing of a grinding wheel cleaning device for a conventional grinder.
Figure 21:
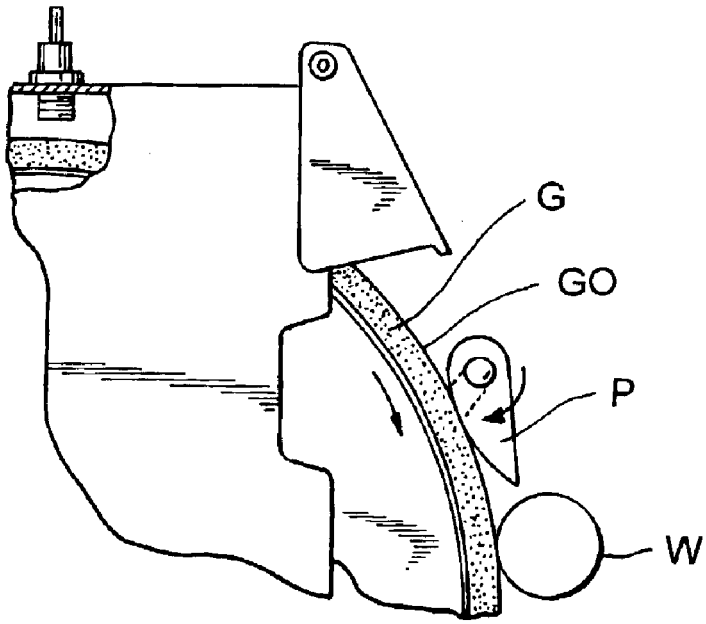
Fig. 21 (Prior Art)
FIG. 21 is a partial side-view drawing of a conventional coolant fluid supplying device.

Example I, which uses an air jet from the air jet nozzle 2, was compared to a comparative example based on conventional technology that does not use an air jet, as shown in FIGS. 4 and 6. However, as shown in FIGS. 17–18, it is also possible to compare the thickness of the air layer 12 along the circumferential surface 10 of the grinding wheel 1 of Example I and a comparative example from conventional technology. This comparison illustrates that the coolant from the grinding fluid nozzle 3 does not adhere to the grinding point 11 and the circumferential surface 10 of the grinding wheel 1 in the conventional technology.

Figure 23A:
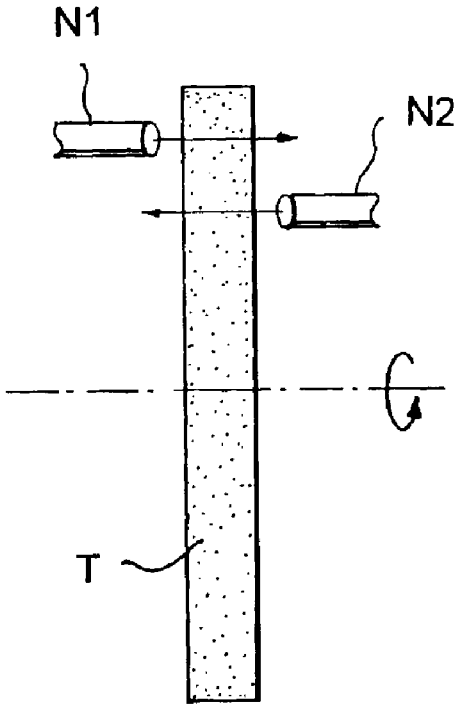
FIG. 23A is a partial front-view drawing showing the positioning of nozzles in an alternative example of the present invention.
Figure 23B:
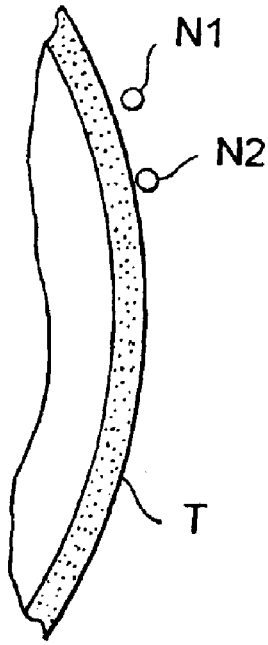
FIG. 23B is a partial side-view drawing showing the positioning of nozzles in an alternative example of the present invention.
Figure 24A:
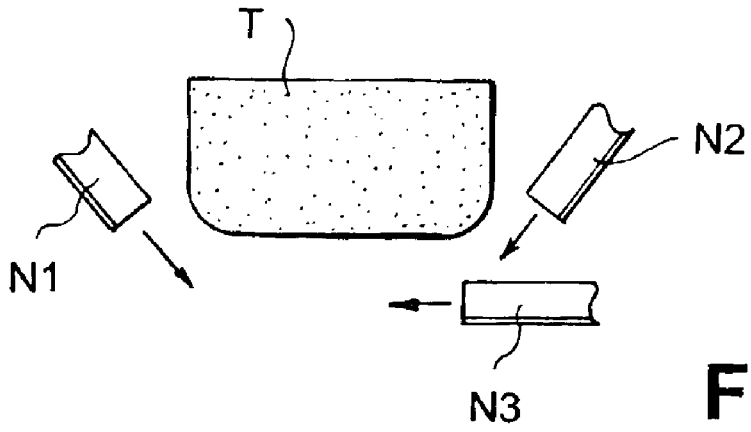
FIG. 24A is a drawing showing the positioning of nozzles in another alternative example of the present invention.
Figure 24B:
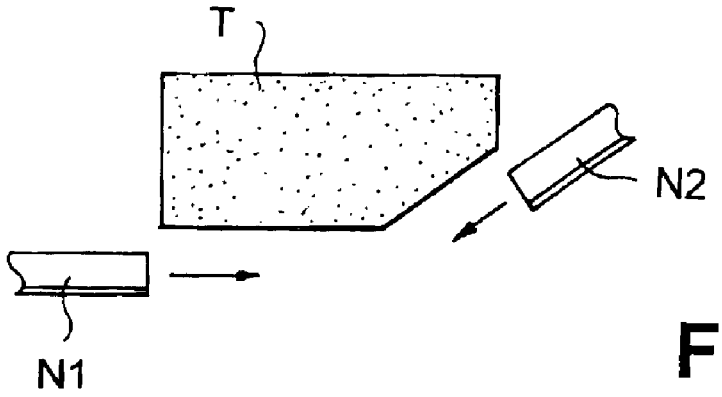
FIG. 24B is a drawing showing the positioning of nozzles in another alternative example of the present invention.
Figure 24C:
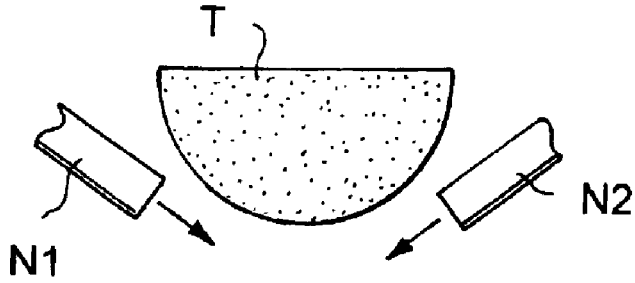
FIG. 24C is a drawing showing the positioning of nozzles in another alternative example of the present invention.

In the examples above, the air jet is described as blowing from one lateral side of the grinding wheel and across the circumferential surface of the grinding wheel. However, the present invention can also be implemented in an alternative manner as shown in FIGS. 23A–23B wherein the air jet cannot redirect the air flow in the air layer over the entire width of the grinding wheel. In this case, a fluid jet or an air jet is blown from the left and right lateral sides of the grinding wheel T. Multiple nozzles N1, N2, N3 can be used in cases in which the grinding wheel is wide and formed with radius curves at its sides as shown in FIG. 24A, cases in which the grinding wheel is tapered as shown in FIG. 24B, or cases in which the grinding wheel is formed as a radius curve as shown in FIG. 24C.

Figure 25:
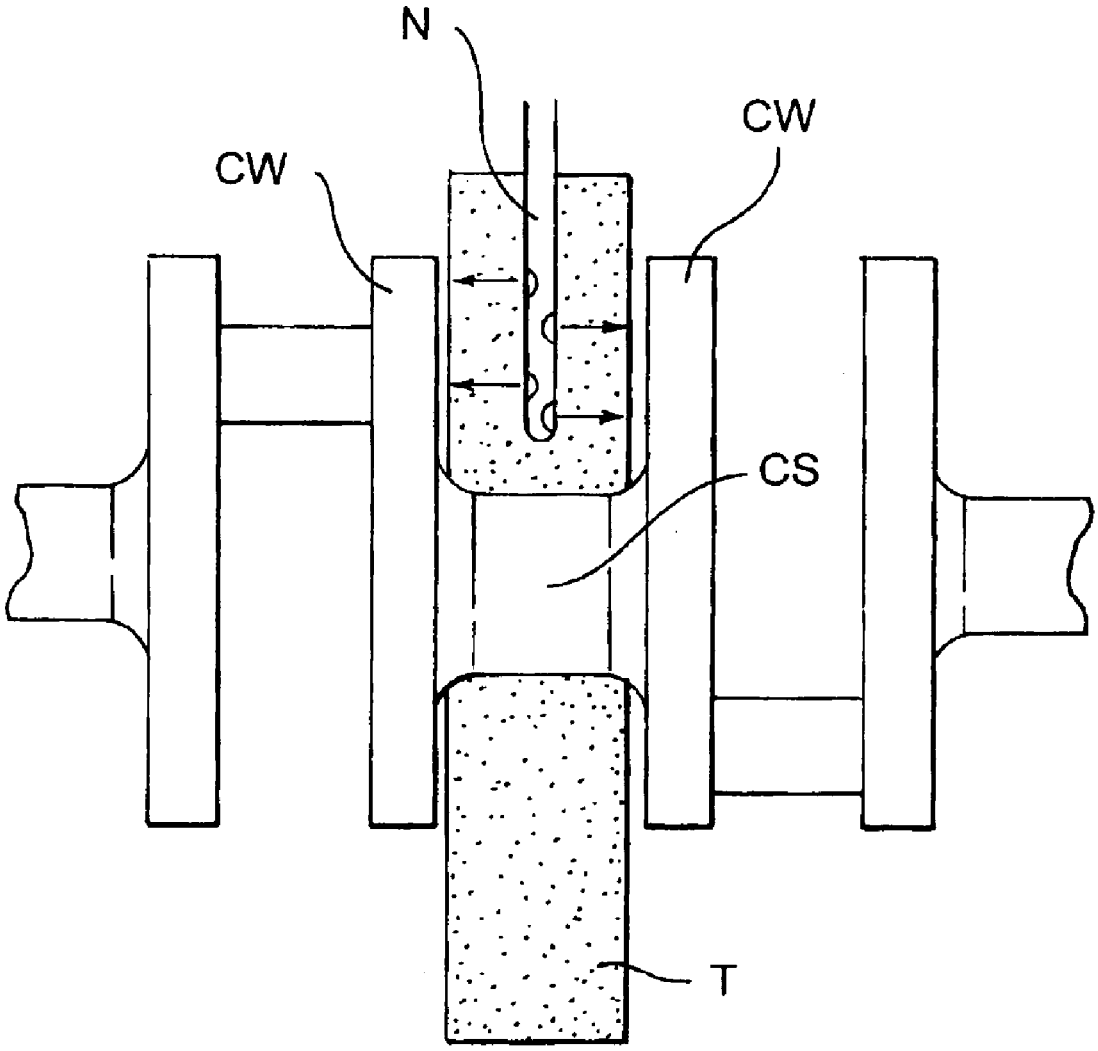
FIG. 25 is a partial front-view drawing showing the positioning of a nozzle in another alternative example of the present invention.

The workpiece can be a crank shaft CS or the like and the grinding wheel T can be interposed between counterweights CW as shown in FIG. 25. Therefore, the present invention can be implemented so that a nozzle N is positioned at the lateral center of the circumferential surface of the grinding wheel T. The nozzle N serves as an air supply pipe so that air jets are supplied to the left and the right from multiple openings on either side of the nozzle N. Thus, flow from the air jets are dragged along the circumferential surface of the grinding wheel T.

Figure 26:
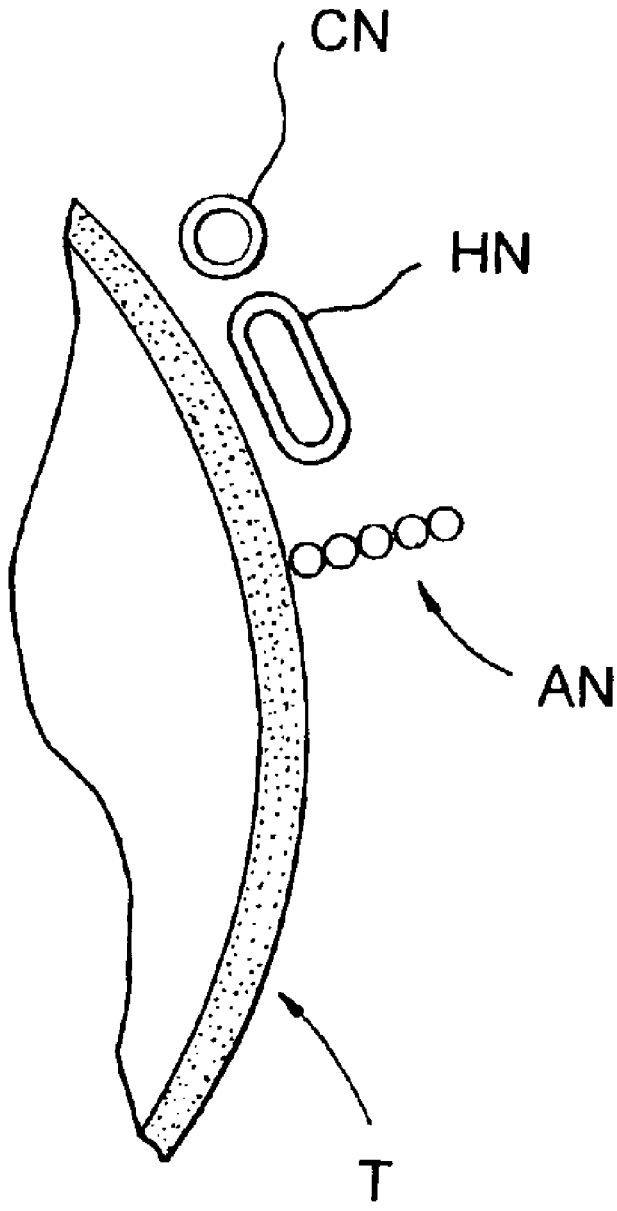
FIG. 26 is a partial side-view drawing showing the positioning of nozzles and shapes for the openings thereof in alternative examples of the present invention.

An alternative example as shown in FIG. 26 can also be implemented so that, instead of a circular nozzle CN with a standard circular opening, the opening of the nozzle N supplying the air jet to the circumferential surface of the grinding wheel T is formed as a flat nozzle HN with a slit-shaped opening or an array nozzle AN with multiple circular openings. The present invention does not impose special restrictions on the shape or arrangement of the openings, and the claims of this invention can cover various configurations.

Figure 27A:
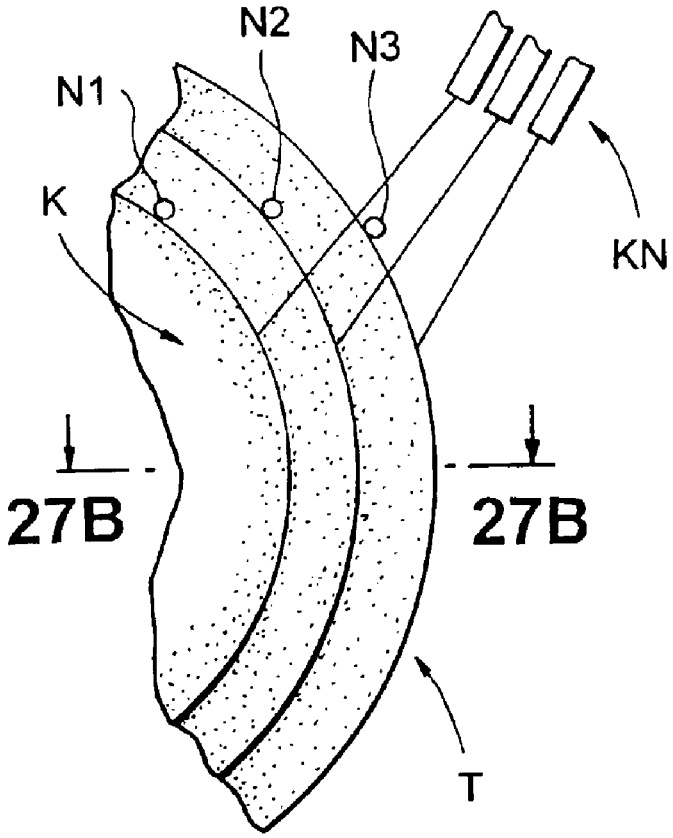
FIG. 27A is a partial side-view drawing showing the positioning of nozzles in another alternative example of the present invention.
Figure 27B:
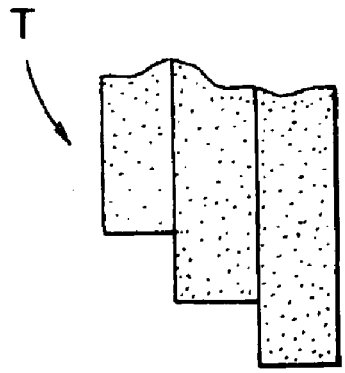
FIG. 27B is a cross-sectional drawing along the 27B—27B line showing the cross-sectional shape of the grinding wheel.

For a form grinding wheel T having multiple layers, radius-curves, tapers, or the like, as shown in FIGS. 27A–27B, the present invention can be modified to stop air flow acting on each of the circumferential surfaces using multiple nozzles N1, N2, N3, thereby allowing a coolant nozzle KN to reliably supply a low volume of coolant to a grinding point K.

Having described embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for supplying a coolant into a grinding point between a workpiece to be ground and a rotating grinding wheel, said method comprising the steps of:

blowing an air layer comprising a flow of air dragged along a grinding surface of said rotating grinding wheel, laterally to the circumference of said grinding wheel, not perpendicular to an axis of rotation of said grinding wheel, and at a cut off position above said grinding point to interrupt said air layer from said cutoff position through said grinding point; and supplying coolant to a contact point below said cutoff position and above said grinding point, thereby guiding said coolant along said grinding surface of said grinding wheel to said grinding point on said grinding surface of said grinding wheel.

2. A method as described in claim 1, wherein:

said blowing comprises blowing, at said cutoff position and from one lateral side of said air layer to another lateral side thereof, a fluid jet, thereby redirecting and removing said air layer from said grinding surface of said grinding wheel;

said coolant is supplied between said cutoff position and said grinding point; and said coolant contacts said grinding point on said grinding surface of said grinding wheel.

3. A grinding device comprising:

a fluid nozzle disposed above a grinding point on a grinding surface of a substantially vertically rotating grinding wheel, said fluid nozzle being adapted to blow a fluid jet laterally to a circumference of said grinding wheel, not perpendicular to an axis of rotation of said grinding wheel, and at a cutoff position above said grinding point at which a workpiece contacts said grinding wheel, to interrupt an air layer from said cutoff position through said grinding point, said air layer comprising a flow of air dragged along a grinding surface of said rotating grinding wheel; and a grinding fluid nozzle adapted to supply a coolant between said cutoff position and said grinding point on said grinding surface of said grinding wheel.

4. A grinding device as described in claim 3, wherein said fluid nozzle is disposed at a horizontal angle relative to said grinding surface of said grinding wheel on a horizontal plane.

5. A grinding device as described in claim 3, wherein said fluid nozzle is disposed at a vertical angle relative to a horizontal 0° angle parallel to an axis of said grinding wheel on a vertical plane.

6. A grinding device as described in claim 3, wherein said fluid nozzle is disposed at a distance above said contact point where said coolant supplied from said grinding fluid nozzle contacts said grinding surface of said grinding wheel.

7. A method for grinding a workpiece on a substantially vertically rotating grinding wheel, said grinding wheel having a grinding point at which said workpiece contacts said grinding wheel, said method comprising the steps of:

blowing an air layer comprising a flow of air dragged along a grinding surface of said rotating grinding wheel, laterally to the circumference of said grinding wheel, not perpendicular to an axis of rotation of said grinding wheel, and at a cut off position above said grinding point to interrupt said air layer from said cutoff position through said grinding point; and supplying coolant to a contact point below said cutoff position and above said grinding point, thereby guiding said coolant along said grinding surface of said grinding wheel to said grinding point thereon; and contacting said workpiece with said grinding wheel at said grinding point.

8. A method as described in claim 7, wherein:

said blowing comprises blowing, at said cutoff position and from one lateral side of said air layer to another lateral side thereof, a fluid jet, thereby redirecting and removing said air layer from said grinding surface of said grinding wheel;

said coolant is supplied between said cutoff position and said grinding point; and said coolant contacts said grinding point on said grinding surface of said grinding wheel.

* * * * *